US005493839A

United States Patent [19]

Sax et al.

[11] Patent Number: 5,493,839

[45] Date of Patent: Feb. 27, 1996

[54] STRUCTURAL BUILDING PANEL AND PANEL SYSTEM

[76] Inventors: Hilary H. Sax, 8568 Burton Way, #311, Los Angeles, Calif. 90048; Robert L. Timbrook, 883 Linda Flora Dr., Los Angeles, Calif. 90049

[21] Appl. No.: 391,961

[22] Filed: Feb. 21, 1995

[51] Int. Cl.[6] ..... E04C 2/36

[52] U.S. Cl. ..... 52/793.11; 52/271; 52/281; 52/293.3; 52/295; 52/592.1

[58] Field of Search ..... 52/592.6, 592.1, 52/793.11, 271, 281, 169.8, 293.3, 293.1, 294, 295

[56] References Cited

U.S. PATENT DOCUMENTS

| | | | |
|---|---|---|---|
| 2,086,571 | 7/1937 | Novambére | 52/793.11 X |
| 2,129,441 | 9/1938 | Otto | 52/793.11 X |
| 3,420,023 | 1/1969 | Gregori | 52/793.11 X |
| 3,496,052 | 2/1970 | Odenthal | 52/793.11 X |
| 4,297,817 | 11/1981 | Bullock et al. | 52/793.11 X |

*Primary Examiner*—Carl D. Friedman
*Assistant Examiner*—Christopher Todd Kent
*Attorney, Agent, or Firm*—Rapkin Gitlin & Moser

[57] ABSTRACT

A structural building panel and building system for constructing preformed or modular housing and other structures comprising a sandwich construction of an outer skin including a pair of parallel spaced opposed panels with an attached inner core comprising a third panel in combination with a plurality of fourth panels secured and arranged in spaced side by side relation transversely on either side of the third panel. A tongue like projection co-extensive with one side edge of the third panel defines a male end and a grooved section co-extensive with the opposite side edge of the third panel defines a female end. The male and female ends are adapted to interlock with respective female and male ends, which are bonded together, on adjacent like panels that are formed in a modular fashion to erect a wall, floor or roof component of the structure. Elongated channels are provided along the top and bottom portions of each individual panel to accommodate interlocking support members.

9 Claims, 5 Drawing Sheets

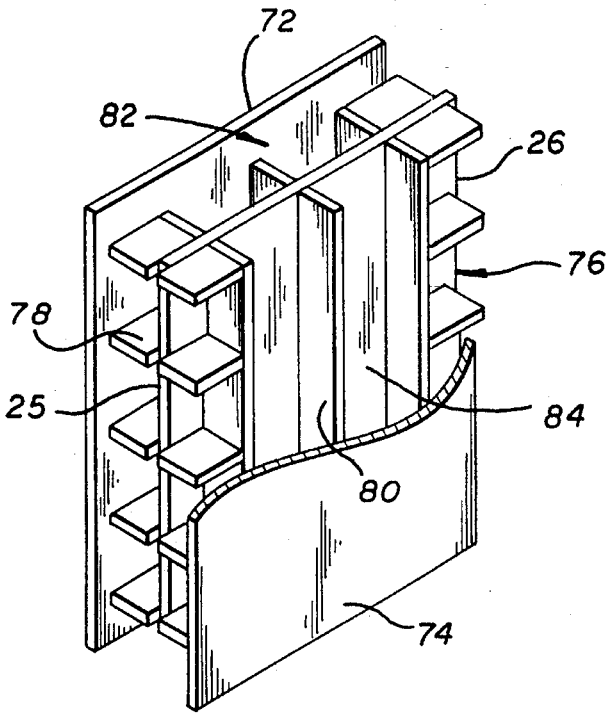
FIG. 2A
FIG. 9
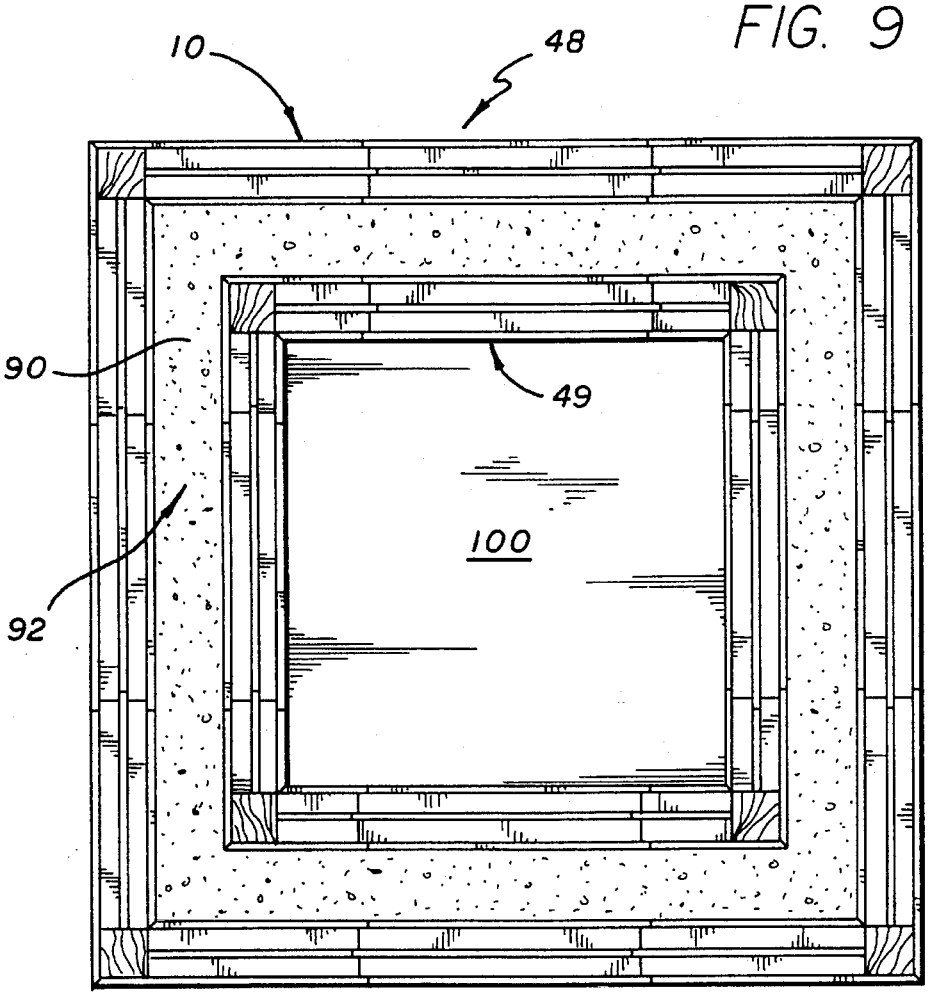

STRUCTURAL BUILDING PANEL AND PANEL SYSTEM

BACKGROUND OF THE INVENTION

1. Field of the Invention

The present invention relates generally to the construction industry and more particularly, to interlocking structural panels for use in building houses and other structures.

2. Description of the Prior Art

For many years, the desire for more economical housing has encouraged the development of a wide variety of structural building panels. An example are pre-assembled or pre-formed sandwich building panels, which are capable of fabrication off-site and then immediately being transferred to the building site, where they are easily and quickly erected at a minimum investment in cost and labor. The same kind of panels can also be fabricated at the building site.

Conventional building methods include the use of medium to high grade lumber materials usually employed on-site. These methods are demanding of much higher costs and substantially more labor, which translates into a finished structure that costs a great deal more money than one built using pre-formed panels.

A variety of problems are associated with the use of sandwich building panels in the prior art, including issues of overall structural integrity, component strength, compliance with rigid local building codes, economy of production and installation and building design compliance. Prior art building materials, such as lumber, depending upon how it is treated may also be extremely flammable. These earlier panels also suffer from the disadvantage of having to be constructed of different materials, the outer sheets or skin being made from one kind of material and the inner core being fabricated from another. This typically adds to the labor and cost of materials resulting in a more expensive end product.

Also, panels constructed of plywood or some other similar material are usually extremely heavy, which can create safety problems, and typically do not offer the kind of anti-shear resistance usually demanded by most, if not all, of the modern day building codes, especially those in earthquake zones and high wind environments.

Also inherent in the prior art are problems relating to the employment of wood forms to construct concrete walls for building a subterranean space, such as a basement. For example, in the prior art, a typical concrete form will utilize sheets of lumber, which have increased substantially in price over time, between which a concrete slurry is poured and eventually hardens. Conventional wire rods and rebar are usually employed to enhance the strength and integrity of the hardened concrete after the forms are removed. The problems involve the relatively high cost of the labor utilized to construct and later remove the forms. Another problem relates to the limited insulation offered by the concrete, which typically is exposed over its entire exterior surface to the surrounding soil and the moisture, heat and cold that penetrate through the soil.

The present invention is a vast improvement over the prior art panels and systems as it provides solutions to the problems described previously, including offering fireproof sandwich building panels that contain no wood, are easily fabricated and installed on-site and have a substantially higher level of structural integrity and strength. Each panel contains an inner core element, which is made of the same fireproof material as the outer panels. The core element includes a cooperating tongue and groove side design employed to resist anti-shear forces from all directions when a series of adjacent like panels are joined and bonded together. Shear forces are those forces which are directed at an object, in this instance an upstanding wall panel, from above, below or either side. Typically, this is the force that the walls of a building structure are least able to resist. A building that is able to resist shear loads by absorbing or transferring and distributing the loads among a series of panels is much more resistant to the kind of destruction usually caused by earthquakes and high winds.

The present invention also offers improvement over the prior art in the area of construction of subterranean spaces, such as a basement. The building panels and system, as described heretofore, may be employed to construct concrete forms, which are then left as a permanent part of the structure after the concrete cures. Using the same core element, alone or in combination with a prescribed amount of insulating material, these panels act initially as a concrete form and, thereafter, as a finished wall component for the basement interior and an effective insulator provided around the entire subterranean space. As they are not removed after the concrete hardens, there is an enormous savings in labor costs normally associated with the removal of the forms.

SUMMARY OF THE INVENTION

The present invention provides a structural building panel and building system for constructing conventional or modular housing and other structures. Accordingly, in an exemplary embodiment of the present invention, the structural building panel comprises a sandwich construction of an outer skin including a pair of parallel spaced opposed panels with an attached inner core comprising a third panel in combination with a plurality of fourth panels secured and arranged in spaced side by side relation transversely on either side of the third panel. A tongue like projection co-extensive with one side edge of the third panel defines a male end. A grooved section co-extensive with the opposite side edge of the third panel defines a female end. The male and female ends are adapted to interlock with respective female and male ends, which are bonded together, on adjacent like panels that are formed in a modular fashion to erect a component of the structure, such as, for example, a side wall. The panels may also be bonded together and employed to construct the floors and the roof of the building structure. Elongated channels are provided along the top and bottom portions of each individual panel to accommodate interlocking support members.

Accordingly, it is an object of the present invention to provide an improved structural building panel and building system that employs tongue and groove like bonded socket elements to enable the interlocking of a series of such panels.

It is a further object of the present invention to provide an improved structural building panel and building system that employs a panel which, when in a cooperating interlocking engagement with a plurality of like panels, will act to transfer and absorb the shear loads from one panel to another and ultimately dissipate the shear forces.

It is another object of the present invention to provide an improved structural building panel and building system that employs a panel that includes an inner core sandwiched between two outer layers to provide greater strength and resistance to shear forces introduced from all directions.

It is yet another object of the present invention to provide an improved structural building panel and building system that conforms to the strictest requirements of uniform building codes throughout the United States.

It is yet another object of the present invention to provide an improved structural building panel and building system that employs a panel which is pre-fabricated.

It is yet another object of the present invention to provide an improved structural building panel and building system that may be employed to construct the wall, floor and roof components of a house or some other kind of building.

It is yet another object of the present invention to provide an improved structural building panel and building system that may be utilized to construct permanent concrete forms for use in the formation of a basement and other types of subterranean spaces.

It is yet another object of the present invention to provide an improved structural building panel and building system that includes forms for concrete basement walls that remain after the concrete hardens to form an insulating barrier and a foundation for easily and cost effectively finishing off the basement's interior walls.

It is yet another object of the present invention to provide an improved structural building panel and building system that is fireproof and resists water and infestation of vermin and termites.

It is yet another object of the present invention to provide an improved structural building panel and building system that is simple and economical to manufacture.

It is yet another object of the present invention to provide an improved structural building panel and building system that is easy and economical to be manufactured in a relatively inexpensive plant and installed at the building site.

Other objects and advantages of the present invention will become apparent in the following specifications when considered in light of the attached drawings wherein the preferred embodiment of the invention is illustrated.

BRIEF DESCRIPTION OF THE DRAWINGS

FIG. 2A is a cutaway perspective view of an alternative embodiment of a building panel in accordance with the present invention.

FIG. 9 is a top perspective of a building's basement in accordance with the present invention taken along lines 9—9 of FIG. 8.

DETAILED DESCRIPTION OF THE PREFERRED EMBODIMENT

Figure 1:
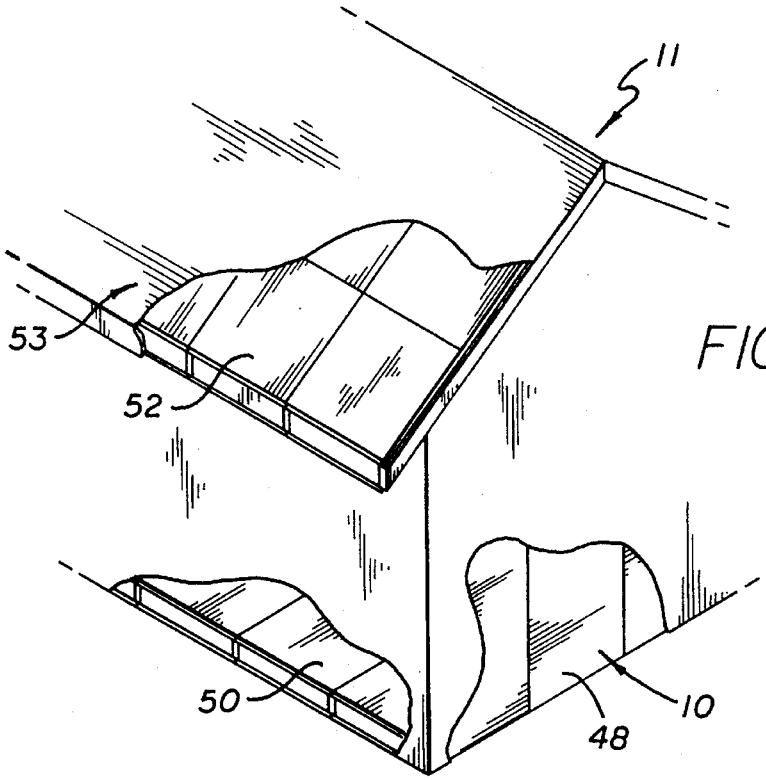
FIG. 1 is a perspective cutaway view of a building construction using the structural building panels and building system of the present invention.

The present invention relates to interlocking sandwich style building panels for use in building houses and other structures as illustrated in FIGS. 1–9. Each building panel 10, which may be fabricated in its entirety from gypsum board or any other suitable fireproof and cost effective material, is comprised of an outer skin including a panel sheet 12 and a panel sheet 14, and core element 16 situated and permanently fixed in between panel sheets 12 and 14, in essence creating a sandwich type of structure. The various components of fireproof core element 16, as will be described hereinbelow, are also comprised of gypsum board or some other suitable material consistent with the character and composition of the outer skin.

Each individual building panel 10 is approximately four (4) feet by eight (8) feet in size and generally will correspond in its dimensions to the size of a typical piece of plywood normally employed in conjunction with conventional building methods. The size of panel 10 may vary, however, depending upon the structural requirements and other needs of the particular project. Building panel 10 may be pre-assembled at one location and then transported to the building site, where it is erected. The panels can also be fabricated at the building site, if desired.

Figure 2:
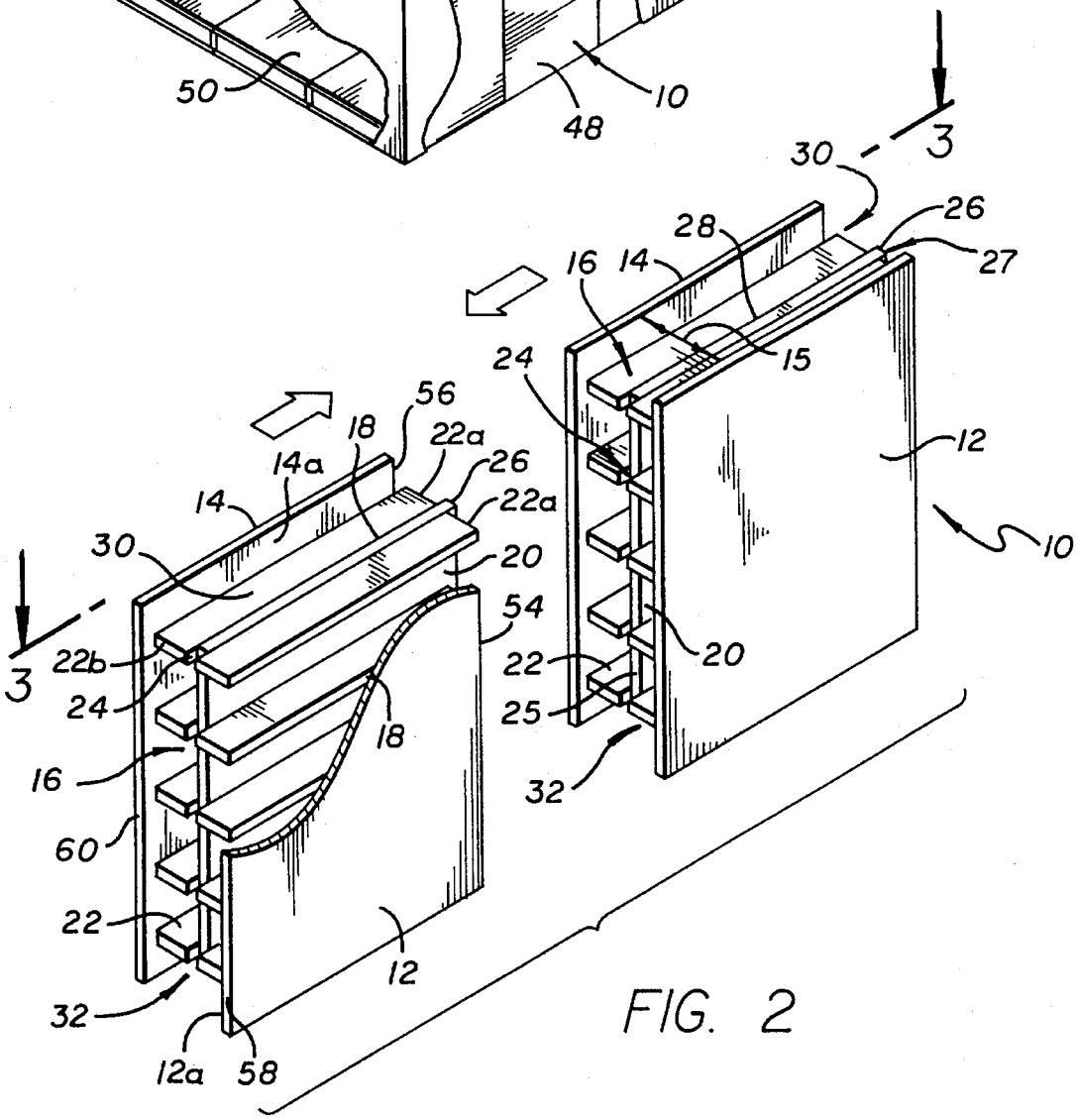
FIG. 2 is a perspective view showing two joinable building panels in accordance with the present invention with one such panel being shown in a partial cutaway perspective view to reveal a portion of the core element.
Figure 5:
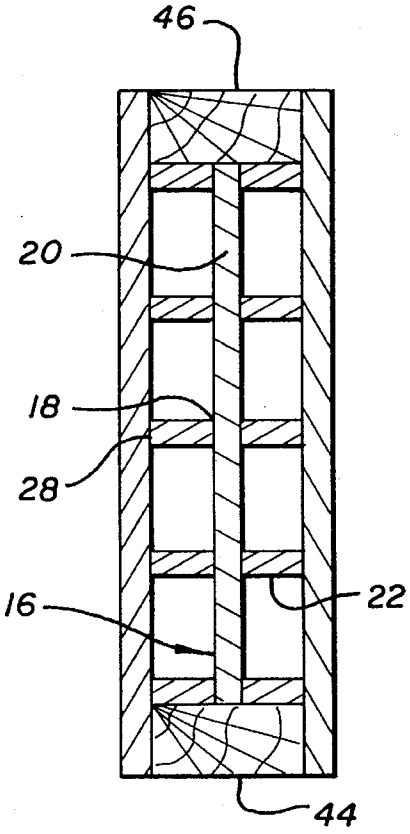
FIG. 5 is a cross-sectional top perspective view of a single building panel in accordance with the present invention showing the engagement with the top and bottom support members.

The space 15 between the panel sheets 12 and 14 typically measures about four (4) inches across and may be less or even as much as six (6) inches or more, as required. Core element 16 is comprised of a panel sheet 20, which has approximately the same overall dimensions as panel sheets 12 and 14. A plurality of narrower panel sheets 22 are arranged in spaced side-by-side relation transversely on either side of panel sheet 20, as shown in FIG. 2. Using any suitable cement or adhesive 28, core element 16 is permanently secured to the interior surfaces 12*a* and 14*a*, respectively, of panel sheets 12 and 14. Using a suitable cement or adhesive 18, each individual panel sheet 22 is permanently affixed to panel sheet 20. Panel sheets 20 and 22 are also comprised of gypsum board or any other fireproof material suitable for the intended purpose of the present invention.

A tongue-like projection 26 coextensive along edge 27 of panel sheet 20 defines a male end. Channel 24 coextensive along edge 25 of panel sheet 20 defines a female end. End portion 22*a* of panel sheet 22 extends just beyond the edge portions 54 and 56 of panel sheets 12 and 14, respectively. End portion 22*b* is recessed just inside the edge portions 58 and 60 of panel sheets 12 and 14, respectively. Projection 26, in cooperation with extended end portion 22*a*, and channel 24, in cooperation with recessed end portion 22*b*, are adapted for interlocking engagement with their respective counterpart elements employed with like adjacent panels.

Figure 3:
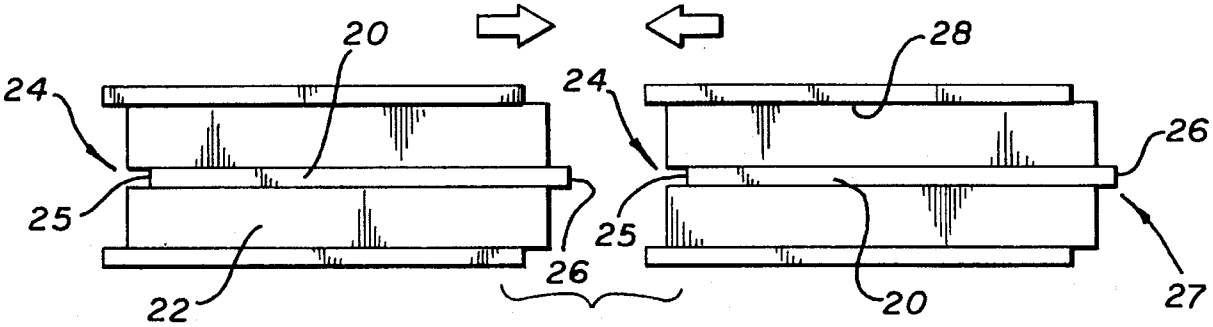
FIG. 3 is a top perspective view of two joinable building panels in accordance with the present invention taken along lines 3—3 of FIG. 2.
Figure 4:
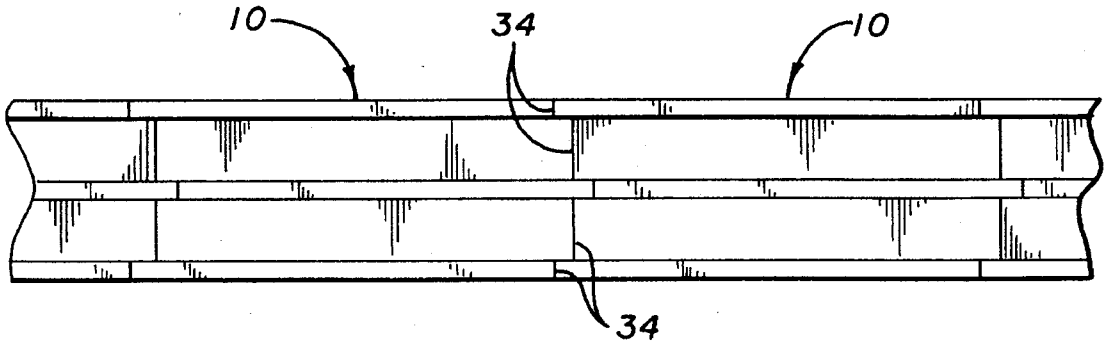
FIG. 4 is a top perspective view of a series of building panels, including two complete panels in the center and two shortened panels at either end (for illustration convenience) joined together in accordance with the present invention.

In a typical application of the device and system of the present invention, which may be employed to build structure 11 as illustrated in FIG. 1, a series of building panels 10 are joined and bonded in interlocking engagement in the manner shown in FIGS. 2, 3 and 4. As each panel is tightly interlocked and bonded using any suitable cement or adhesive at juncture 34 with an adjacent panel, there is a progressive increase in the strength and structural integrity of the structure being formed. The interlocking nature of the panels with one another in combination with the enhanced strength provided by the core element 16 creates potential for an enhanced resistance to the shear forces potentially introduced in the building from all directions. Thus, a shear force directed at a series of the joined panels from the side would be absorbed and distributed among all the panels in that particular series. Unlike the prior art, these panels, in accordance with the present invention, cooperate to spread the force and, thus, undermine its destructive impact.

Each panel 10 includes an upper channel 30 and a lower channel 32 for receiving corresponding support members 46 and 44, respectively. Typically, members 44 and 46 are 2"×4" or 2"×6" pieces of lumber provided to act both as guide members and structural enhancements to the series of panels 10 as they are joined and bonded to form, for example, an entire wall component or the roof of the building. Member 44 is usually installed in the concrete foundation of the building where it engages lower channel 32. Member 46 engages upper channel 30 and acts as a bridge or juncture between the uppermost section of panel 10 and the edge of the roof 53 comprised of a series of interlocking roof panels 52. Floor panels 50 may also be employed and, as required, can interlock with wall panels 48 using any conventional means for this purpose.

Junctures where walls meet at the corners of the building or meet the roof or the floor are joined and secured using any conventional means, such as nails or bolts, for this purpose.

FIG. 2A illustrates an alternative embodiment of a building panel in accordance with the present invention. This embodiment includes, as with the preferred embodiment, panel sheets 72 and 74 and core element 76 fixed and bonded in between. The principal difference with this embodiment of the invention is the physical design of core element 76 which, unlike its counterpart with the preferred embodiment, includes a plurality of horizontally oriented panel sheets 78 and vertically oriented panel sheets 80 arranged generally in the mid- section 82 of core element 76 in spaced side-by-side relation transversely on either side of panel sheet 84. Each panel sheet 78, which is a shorter version of panel sheet 22, is arranged adjacent to edges 25 and 26. The principal advantage of the alternative embodiment of the present invention is to enable the accommodation of electrical wiring either horizontally or vertically within an individual panel or throughout a series of such panels joined and bonded together. There is also provided an improved resistance to compression forces that could act upon the panels under certain conditions.

Figure 6:
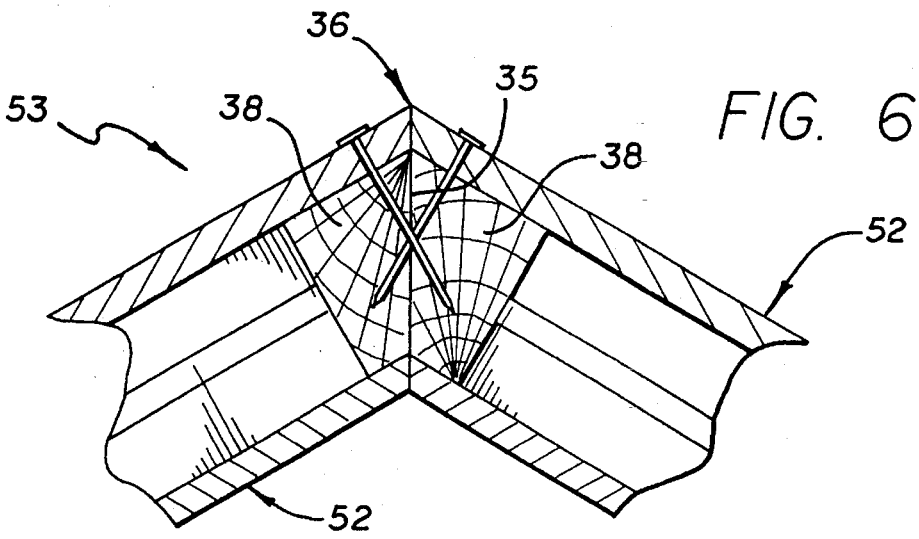
FIG. 6 is a cross-sectional view of the end portions of two building panels forming a connection at the roof ridge.

As shown in FIG. 6, a series of roof panels 52 are joined and bonded together to construct a roof 53 in accordance with the present invention. At the roof ridge connection 36, the roof panels 52 situated on either side of the roof ridge connection 36 will join and connect together using conventional nails or any other suitable means. Roof ridge end fillers 38 usually comprised of wood or some similar type of material are provided to fill the gap or space between the end of the panel 52 and the ridge juncture 35.

Figure 7:
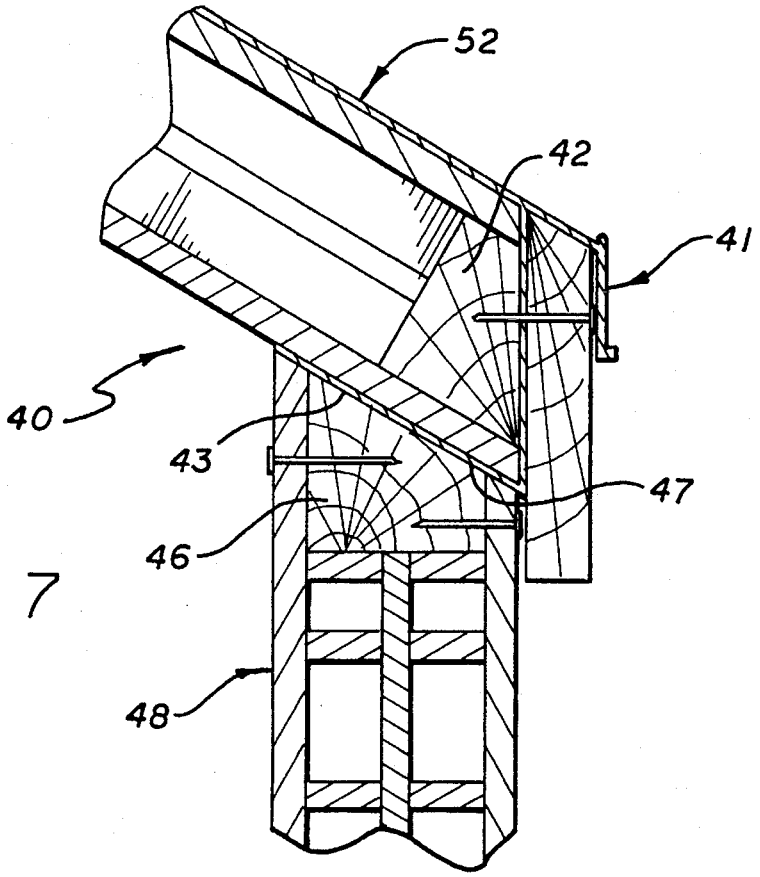
FIG. 7 is a cross-sectional view of the end portions of two building panels forming a flush connection at the roof eave.

FIG. 7 illustrates the roof eave connection 40 formed at the juncture 43 of the roof eave 41 and the upper edge 47 of a wall panel 48. Again, the panels 48 are connected using conventional nails or any other suitable means. A roof eave filler 46 comprised of wood or some other suitable type of material is provided to fill the space between the end of the roof panel 52 and the eave juncture 43.

Figure 8:
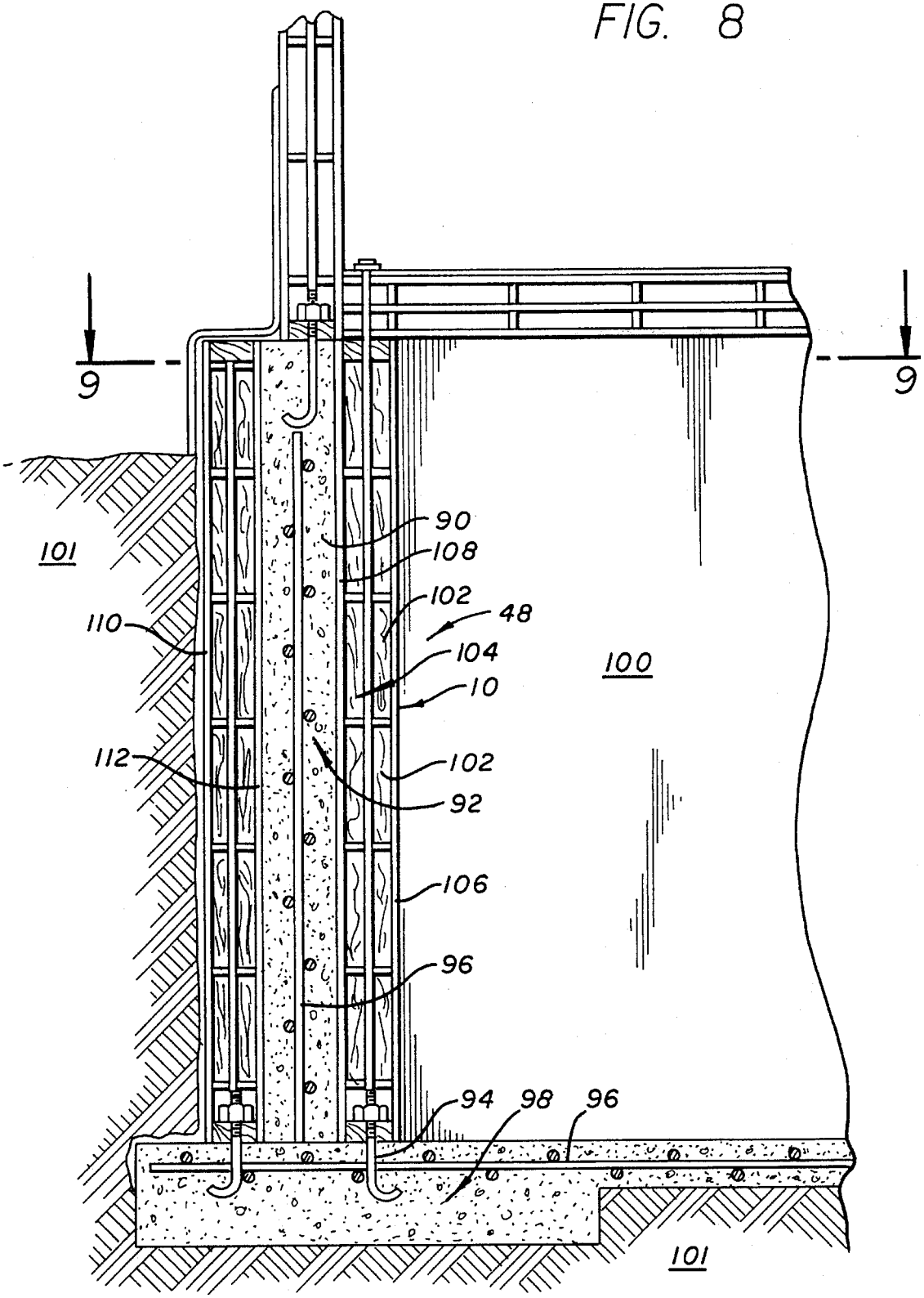
FIG. 8 is a cross-sectional view of the present invention employed to Construct concrete basement wall forms.

FIGS. 8 and 9 illustrate the use of a series of joined and bonded wall panels 48 and 49 to construct a concrete form for casting a concrete basement wall. Instead of using conventional low quality and expensive lumber to build the forms, as normally employed by conventional building methods, a series of panels 10 are used in accordance with the present invention. Individual bonded panels 10, which form a series of joined and bonded panels 48 and 49, form a perimeter around the designated basement area 100 of the building and are arranged in parallel fashion at least six (6) to ten (10) inches apart depending upon the design needs and structural requirements of the project. A concrete slurry 90 is poured into the space 92 between the series of panels 48 and 49. Metal rods 94 and rebar 96 are employed to ensure that the concrete hardens and binds properly and there is established a fixed connection to the previously poured and formed concrete foundation 98. Rather than removing the series of panels 48 and 49 after the concrete 90 hardens, as would occur with the use of typical wood forms, the series of panels 48 and 49 are left intact and become permanent structures to provide a ready-made foundation upon which to economically finish the basement space 100. Insulation 102 materials may also be provided in the various spaces 104 located between the panel sheets 106, 108, 110 and 112 to protect the basement space 100 from the elements that would otherwise penetrate from the surrounding soil 101.

The fact that the panels and system provided in accordance with the present invention employ much less expensive materials than heretofore used with conventional building methods is but one of the many advantages of the invention. The expedient nature of the invention, including the ease of pre-fabrication of the individual panels, the ease of the installation on-site and the substantial cost and labor saved in the process over the prior art methods make the invention an even greater improvement. The present invention also provides a building structure with an increased overall strength, utilizes building panels that have a wide range of structural and design application and, because of their interlocking and bonded feature, are more capable than any of their precursors of resisting shear forces introduced from any direction in the building and transferring and absorbing these forces throughout the entire structure.

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended claims.

What is claimed is:

1. A wall unit for buildings comprising, a sandwich construction of a pair of spaced first and second panel members and an inner core, said core being formed of an elongated third panel member situated in spaced parallel relation between said first and second panel members and a plurality of fourth panel members arranged in spaced side-by-side fashion transversely on either side of said third panel member in contact relation with said first and second panel members, a tongue-like projection co-extensive with one side edge of said third panel member to define a male end and a grooved section co-extensive with the opposite side edge of said third member to define a female end, said male and female ends adapted for interlocking engagement with respective female and male ends on like adjacent panels, the top and bottom sections of said wall unit, being provided with elongated channels co-extensive with the length of said unit for interlocking engagement with first and second supporting members.

2. The invention as described in claim 1 wherein each of said fourth panel members is approximately equal in length to the length of said third panel member.

3. The invention as described in claim 1 wherein each of said fourth panel members is disposed horizontally relative to the orientation of said first and second panel members.

4. The invention as described in claim 1 wherein each of said fourth panel members is adhesively connected to said third panel member.

5. The invention as described in claim 1 wherein said first and second panel members are comprised of gypsum board.

6. The invention as described in claim 5 wherein said third and each of said fourth panel members are comprised of gypsum board.

7. The invention as described in claim 1 wherein said wall unit is pre-assembled.

8. A system for casting concrete for forming subterranean walls in connection with a dwelling or other building structure, comprising, a first sandwich building panel, said panel including a pair of spaced first and second panel members and an inner core, said inner core being formed of an elongated third panel member situated in spaced parallel relation between said first and second panel members and a plurality of fourth panel members arranged in spaced side-by-side fashion transversely on either side of said third panel member in contact relation with said first and second panel members, a second sandwich building panel, said panel including a pair of spaced first and second panel members and an inner core, said inner core being formed of an elongated third panel member situated in spaced parallel relation between said first and second panel members and a plurality of fourth panel members arranged in spaced side-by-side fashion transversely on either side of said third panel member in contact relation with said first and second panel members, a tongue-like projection co-extensive with one side edge of said third panel member to define a male end and a grooved section co-extensive with the opposite side edge of said third member to define a female end, said first and second sandwich panel members being arranged in spaced apart opposing relation to define a space therebetween and adapted to receive a cement slurry wherein said cement can harden to form a subterranean wall structure in combination with said first and second sandwich panel members.

9. A system for casting concrete for forming subterranean walls in connection with a dwelling or other building structure, comprising, a first sandwich building panel, said panel including a pair of spaced first and second panel members and an inner core, said core being formed of an elongated third panel member situated in spaced parallel relation between said first and second panel members and a plurality of fourth panel members arranged in spaced side-by-side fashion transversely on either side of said third panel member in contact relation with said first and second panel members, a second sandwich building panel, said panel including a pair of spaced first and second panel members and an inner core, said core being formed of an elongated third panel member situated in spaced parallel relation between said first and second panel members and a plurality of fourth panel members arranged in spaced side-by-side fashion transversely on either side of said third panel member in contact relation with said first and second panel members, a tongue-like projection co-extensive with one side edge of said third panel member to define a male end and a grooved section co-extensive with the opposite side edge of said third member to define a female end, said first sandwich panel member being joined in a series with a plurality of adjacent like panel members and said second sandwich panel member being joined in a series with a plurality of adjacent like panel members, said series of first and second sandwich panel members being arranged in spaced apart opposing relation to define a space therebetween and adapted to receive a cement slurry wherein said cement can harden to form a subterranean wall structure in combination with said first and second sandwich panel members.

* * * * *